United States Patent [19]

Henrici et al.

[11] Patent Number: 4,728,295

[45] Date of Patent: Mar. 1, 1988

[54] CONNECTOR BLOCK FOR ELECTRICAL DEVICES

[75] Inventors: Dieter Henrici; Hans Wedding, both of Arnsberg, Fed. Rep. of Germany

[73] Assignee: Brokelmann, Jaeger & Busse, GmbH & Co., Arnsberg, Fed. Rep. of Germany

[21] Appl. No.: 895,834

[22] Filed: Aug. 12, 1986

[30] Foreign Application Priority Data

Aug. 13, 1985 [DE] Fed. Rep. of Germany ..... 3528980
Jun. 26, 1986 [DE] Fed. Rep. of Germany ..... 3621369

[51] Int. Cl.[4] ..... H01R 23/72
[52] U.S. Cl. ..... 439/84; 439/409
[58] Field of Search ..... 339/14 T, 17 C, 221 R, 339/221 M, 14 R, 98, 97, 99 R; 439/84, 409

[56] References Cited

U.S. PATENT DOCUMENTS

| | | | |
|---|---|---|---|
| 3,017,596 | 1/1962 | Johnson | 339/14 T |
| 3,031,635 | 4/1962 | Gluck | 339/14 T |
| 3,072,880 | 1/1963 | Olsson | 339/221 R X |
| 3,343,118 | 9/1967 | Holzer | 339/17 C |
| 4,353,609 | 10/1982 | Haas | 339/17 C |
| 4,363,529 | 12/1982 | Loose | 339/17 C |
| 4,372,634 | 2/1983 | Ritchie et al. | 339/17 C |

FOREIGN PATENT DOCUMENTS

| | | | |
|---|---|---|---|
| 47827 | 3/1982 | European Pat. Off. | 339/17 C |
| 1047273 | 12/1958 | Fed. Rep. of Germany | 339/17 C |
| 1182623 | 2/1970 | United Kingdom | 339/17 C |

*Primary Examiner*—William R. Briggs
*Attorney, Agent, or Firm*—Karl F. Ross; Herbert Dubno

[57] ABSTRACT

The electrical connector block comprises an insulating body and a plurality of conductor terminals mounted in it of which at least one is a protective conductor terminal. It is provided with an additional contacting member which passes through the base of the insulating body facing a connector block support and has at least one exterior plug which can directly make contact in a socket in the connector block support. The protective conductor plug can be mounted in the connector block during manufacture of the connector block or also subsequently to making the connector block without having to dismantle it. The structure and positioning of the protective conductor plug or plugs allows an easy automatic connection to the protective conductor by plugging the conector block into the connector block support.

11 Claims, 8 Drawing Figures

CONNECTOR BLOCK FOR ELECTRICAL DEVICES

FIELD OF THE INVENTION

Our present invention relates to an electrical connector block or terminal block for electrical devices, and more particularly to a connector block for lights, stoves or ovens, machinery, washing machines and the like.

BACKGROUND OF THE INVENTION

An electrical connector block can comprise an insulating body and a plurality of conductor terminals mounted in the body of which at least one is a protective conductor terminal which is provided with an additional contacting member which can make electrical contact in or with the connector block support, e.g. for grounding a conductor affixed to the block.

In one known electrical connector block the ground is usually made by connecting a special cable (grounding cable) to the pole of the connector block to which the protective conductor of the power supply cable is connected. The other end of this special cable is attached to the electrically conducting portion of the device to be grounded, particularly by a terminal screw. This is bothersome and inconvenient.

An electrical row terminal block for a switching device is described in German Patent Document DE-U No. 76 13 429 in which a protective conductor connector body is positioned in a plane displaced with respect to the conductor connector body. The protective conductor plane is positioned substantially in the plane of the connector block support which is a supporting rail. The supporting rail acts simultaneously as a protective conductor rail and the protective conductor connector body is connectable electrically with the supporting rail. This connection is effected by a special clamping mechanism which operates with a separate screw. This clamping mechanism is comparatively expensive and makes the assembly and disassembly of the connector block difficult. Furthermore, the fabrication of the protective conductor terminal is made difficult by additional required manual work.

OBJECTS OF THE INVENTION

It is an object of our invention to provide an improved connector block or terminal block for electrical devices which overcomes the aforedescribed and other drawbacks of the prior art.

It is a further object of our invention to provide an improved connector block for electrical devices which may be easily assembled.

It is another object of our invention to provide an improved connector block or terminal block for electrical devices in which grounding and/or connection to a protective conductor terminal is simplified.

SUMMARY OF THE INVENTION

These objects and others, which will be made more apparent hereinafter are attained in a connector block for electrical devices comprising an insulating body and a plurality of conductor terminals mounted in the insulating body, of which at least one is a protective conductor terminal, which is provided with an additional contacting member, which passes through the base of the insulating body facing a connector block support and can make electrical contact with and/or in the connector block support.

According to our invention, the additional contacting member has at least one exterior plug each of which can be put in direct contact in and engagement with a socketor opening of a conductive connector block support.

Because of the structure of our invention it is only necessary to provide an opening in a normally conductive connector block support for contact with the additional contacting member, the insulating body being anchored to the support as is customary, e.g. by insulating feet. Additional measures or steps, particularly those in the nature of attachments like screwing or the like, are not necessary in the present case. It is enough to mount the connector block on the connector block support in its usual manner, whereby the protective conductor terminal is automatically contacted by the additional plug. Thus the connector block is mounted in the standard way.

To guarantee a particularly reliable contact the plug is advantageously provided with sharp edges to penetrate an insulating layer covering the generally sheet metal connector block support. Thus preparing the connector block support by abrading away the lacquer coating for a reliable contact is dispensed with when our invention is used. The sharp edges of the plug can also be provided on outwardly extending integral resilient prongs. At the same time a tolerance compensating fit of the plug in its socket is guaranteed in an easy way.

The plug can be made in one piece with at least a portion of the protective conductor terminal. A special protective conductor terminal is then installed instead of the standard one in a conductor block cavity which is designed for connection with the protective conductor.

In one embodiment of our invention the plug is a special component which is insertable into and/or extendable to contact the protective conductor terminal from the outside through at least one hole in a base of the insulating body. This embodiment has the advantage that the ground can be designed with a terminal like those for the current carrying conductors. Also, one needs no special shape contacting body but one can return to the conventional structure in regard to this.

A still further improvement of this last mentioned embodiment can be obtained when the plug is connected with the protective conductor terminal from the outside of the insulating body. This has the particular advantage that the connector block can be equipped subsequently with the protective conductor terminal plug, according to our invention, when it is not provided in making or using the connector block. All that is necessary is that a wall or base of the insulating body be provided with a hole or holes or be structured so that a hole or holes can subsequently be made, for example by pushing through, and that the additional contacting member be installed.

In another particularly advantageous embodiment the plug is connectable or attachable with the insulating body and/or with the protective conductor terminal by connecting legs fitting into or forced into them. Thus an easy and timely plug mounting in the connector block and/or in the protective conductor terminal is possible. It is important that at least one of the connecting legs entering into the connector body cavity enters into reliable electrical contact with the protective conductor terminal.

It is also possible within the scope of our invention to connect the plug directly with the protective conductor terminal and of course then the plug is subsequently mounted from the outside of the connector block. This is attained because at least one connecting leg is held clamped into a recess or receptacle of an appropriate size to fit it in the protective conductor terminal.

One of the above-mentioned connecting legs can have a bent insert portion for lateral engagement with one of two holes provided through the base of the insulating body and a folded over plug-in segment for mounting in the other hole. It is also possible to clamp one connecting leg in a recess in the protective conductor terminal, while the other connecting leg is braced by a spreading spring force on a protruding member of the protective conductor terminal.

Advantageously the additional contacting member is formed in a single piece by bending a sheet-metal strip or punched out in a single piece from a flat sheet-metal strip.

In another embodiment of our invention the additional contacting member is composed of a plurality of individual sections including a connecting section extending substantially perpendicularly from the insulating body, a bend section connected to the connecting section and a leg section placed opposite to the connecting section.

This additional contacting member can be provided with two plugs. Each of the plugs is received in a special socket in the connector block support. The leg section of the plugs are positioned facing each other interiorly and the connecting sections of the plugs are positioned exteriorly in the additional contacting member. At least one connecting leg of the additional contacting member can be inserted in a clamping slot of a clip and/or contacting spring of the connector body. The additional contacting member can advantageously be provided with at least one shoulder engagable in a base side fitting groove of the insulating body for centering and mounting. This additional contacting member is provided with hook shape locking catches on the edges of an anchoring section thereof and/or on the plugs for anchoring to the insulating body and/or in the connector body.

The protective conductor terminal can of course be positioned in substantially the same plane as the standard terminals of the connector block.

Our invention allows a structure for a connector block or terminal block to be easily made in a way which automatically makes the protective conductor connection as soon as the connector block is attached to the connector block support. In order to achieve this the connector block can be equipped either at its manufacture with the plug described above or—in a particularly advantageous way—it can be mounted subsequently to the connector block without disassembling it.

BRIEF DESCRIPTION OF THE DRAWING

The above and other objects, features and advantages of our invention will become more readily apparent from the following description, reference being made to the accompanying drawing in which.

SPECIFIC DESCRIPTION

Figure 1:
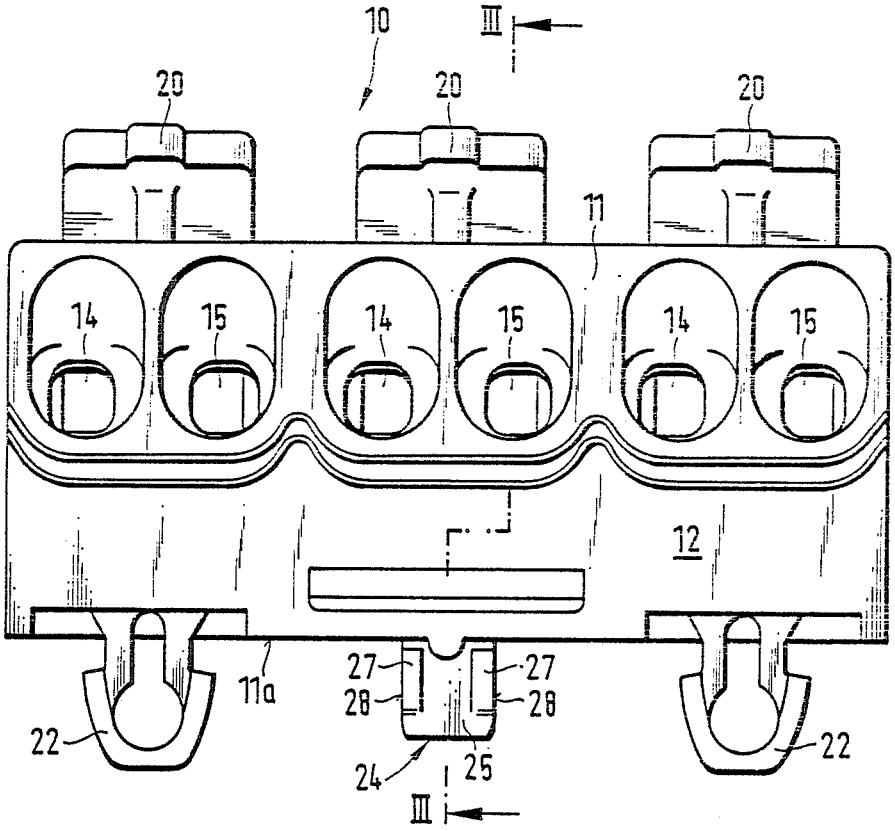
FIG. 1 is a front elevational view of a three pole connector block according to our invention.
Figure 2:
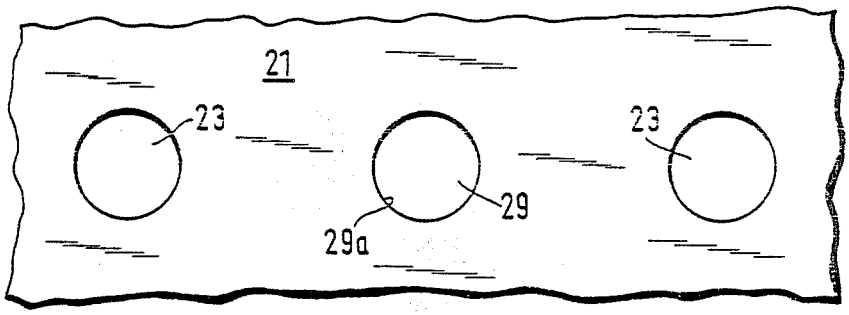
FIG. 2 is a top plan view of a portion of a plate shape connector block support with three sockets provided for mounting and for connection with the protective conductor terminal.

The connector block or connector terminal 10 has a plastic insulating body 11 divided in two parts with a bottom member 12 and a top component 13 insertable and lockable in it which together make up a substantially closed body except for the conductor orifices 14, 15 and 16.

A number of connector body cavities 17 are provided in the insulating body 11 corresponding to the number of poles. Each connector body cavity 17 receives a connector body 18/19 divided into two similar parts in this embodiment.

The first part of the connector body 18/19 is a comparatively stiff substantially U-shape clip or clamp member 18, while the second part is a contacting spring 19 with resilient contacting legs 19' and 19''. The clip 18 acts as a support and holder for the contacting spring 19.

The resilient legs 19' and 19'' of the contacting spring 19 form screwless connecting terminals between their front edges and the opposing surfaces of the clip 18. The connecting terminal formed by the resilient contacting leg 19' may be opened with the help of the key 20 on the outside of the housing according to the user's wishes in order to remove the conductor held therein. When the key is pressed down, the conductor is locked to the connector 18/19.

For plugging into connector block support 21 the connector body 11 has two resilient locking feet 22 on its base or wall **11*a* which can be plugged into the sockets 23 of the connector block support 21. The connector block or connector terminal 10 is then held fixed on the connector block support 21 after being plugged in by the reexpanding insulating locking feet 22** which were compressed on insertion.

The above described structure for the connector block 10 is known and used in earlier models. The structure and arrangement of an additional contacting member 24 with an exterior plug 25 for the protective conductor terminal 26 are in contrast new.

Figure 3:
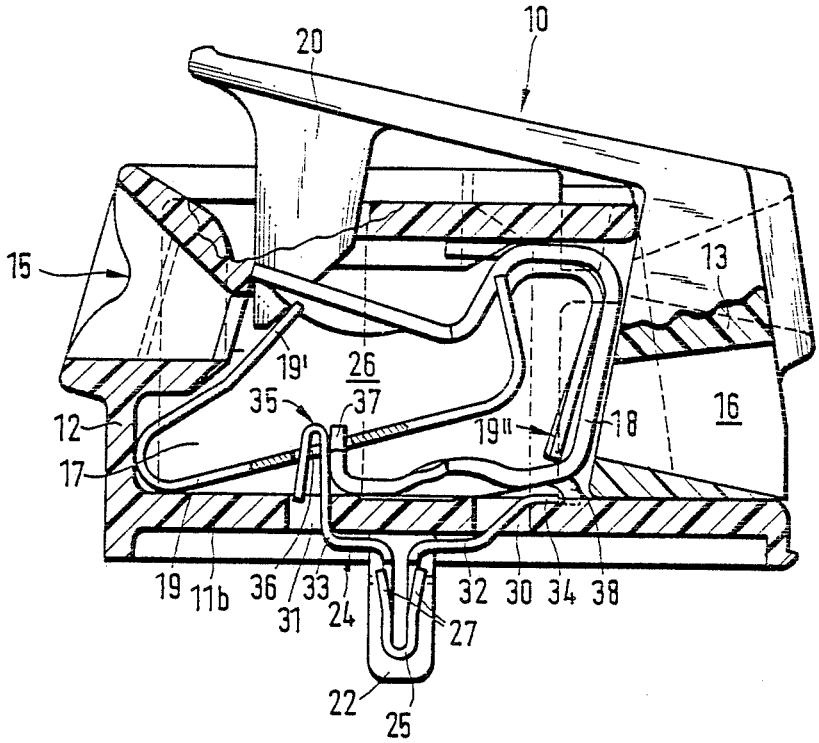
FIG. 3 is a cross-sectional view through the connector block taken along the section line III-III of FIG.

In the embodiment according to FIG. 3 the additional contacting member 24 is formed from a small metal strip which in the most approximate sense is W-shaped as seen in FIG. 1. The plug 25 is made by bending back the metal strip approximately 180°. On both sides of this bent back metal strip there are sometimes two, but here four, flexible prongs 27 bent outwards. Their edges 28 are sharp and/or sharpened.

The plug 25 is designed to be inserted in an additional socket 29 of the connector block support 21. In this embodiment the socket 29 is of the same type and size as the sockets 23 for the resilient locking feet 22 of the insulating body Il. The above mentioned sharp edges 28 of the plug 25 contact the boundary of the socket 29 on insertion and remove the lacquer or oxide coating there by abrasion in order to make an effective electrical contact with the connector block support 21.

As is easily conceived, this contact is made automatically and at the same time as the mounting of the connector block 10 on the connector block support 21. As the connector block 10 is plugged in, the additional contacting member 24 is also connected with the connector block support 21.

In this first embodiment the additional contacting member 24 has a special structure and is fitted from the outside of the insulating body 11. For this purpose, the base 11*b* of the insulating body 11 has two holes 30 and 31 through it for receiving two connecting legs 32 and 33 of the additional contacting member 24. The two holes 31 and 32 are thus in the side of the insulating body 11 facing the connector block support 21.

The connecting leg 32 is formed with an approximately right angle bend and is easily wave like or S-shaped and at one end of it there is an insert portion 34 for bracing on the inner surface of the insulating body base 11*b* next to the hole 30. The second connecting leg 33 is bent so that it is bent back into a U-shape resilient plug-in segment 35 which can be engaged in the other hole 31.

The mounting occurs so that the insert portion 34 of the connecting leg 32 is inserted in the hole 30 while the additional contacting member 24 can be swung in a clockwise sense in reference to FIG. 3 until the plug-in segment 35 reaches the illustrated position.

In this position, the additional contacting member 24 is held only on the base 11*b* of the insulating body 11 so that it is guaranteed that an electrical contact with the connector body 18/19 occurs. One such contact can be made by a simple contact of the additional contacting member 24 in the region where it engages with the surfaces and edges of the connector body 18/19.

In the embodiment according to FIG. 3 a direct connection is possible with the connector body 18/19, although the contacting member 24 is mounted from the outside of the insulating body 11. Thus the bent or folded resilient plug-in segment 35 plugged into the recess or receptacle 36 in the contacting spring 19 simultaneously is provided for contact with a bent up tongue 37 of the clip 18. The other connecting leg 32 opposite the connecting leg 33 because of spring tension presses with the front edge of its free end insert portion 34 against a protruding piece 38 bent out from the clip 18. The additional contacting member 24 is also plugged directly by connecting legs 33 and 32 into the connector body 18/19 so that here the holes 30 and 31 are not needed to hold the additional contacting member 24.

Since it is desired to provide the known connector block with a connector body arrangement with an additional protective contacting member 24 the holes 30 and 31 are placed in the base 11*b* of the insulating body 11 only near the protective conductor connector body cavity 17. In our new insulating bodies 11 these holes 30 and 31 can be provided by punch-out openings, for example by weakening portions of the base 11*b* of the insulating body 11, which are then punched out when the connector block 10 is to be provided with the additional contacting member 24.

Figure 3A:
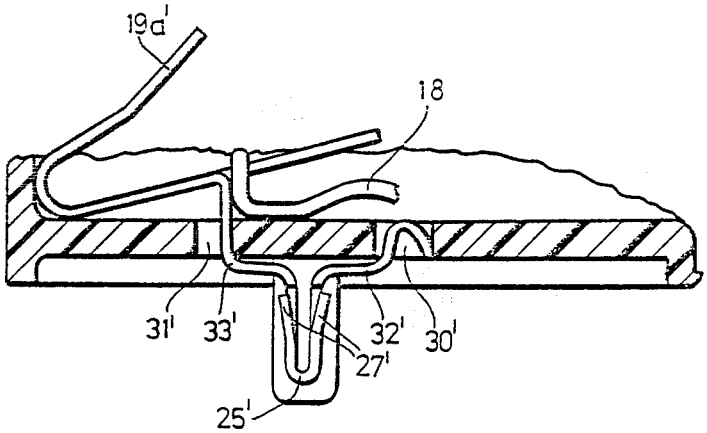
FIG. 3A is a partial section of a modification.

FIG. 3A shows an embodiment generally similar to FIG. 3 but wherein the plug 25′ with its barbs 27′ is formed unitarily with the contact 19*a*′ corresponding to the contact 19. The strip of the contact 19*a*′ is passed out through the opening 31; bent at 33; formed into the plug 25′ and bent and filled at 32′ in the opening 30′.

Figure 4:
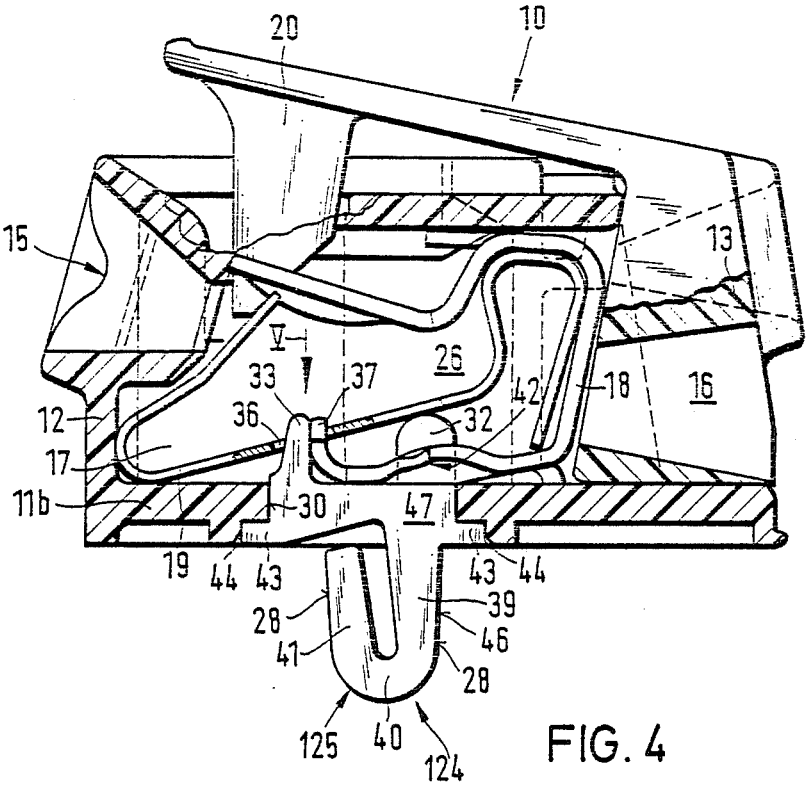
FIG. 4 is a cross sectional view through a second embodiment of a connector block according to our invention corresponding to and similar to FIG. 3.
Figure 6:
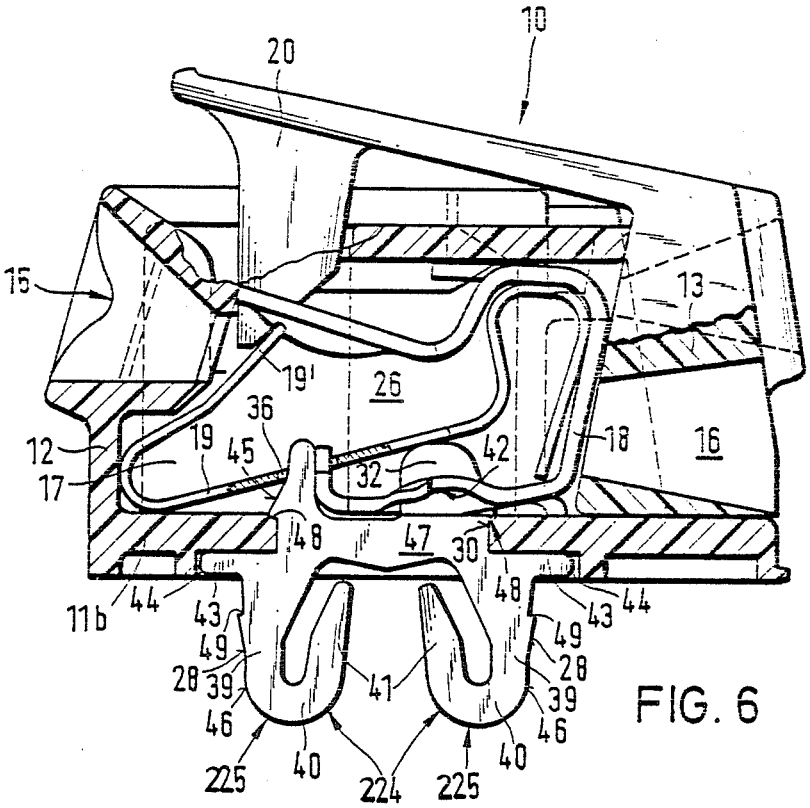
FIG. 6 is a cross sectional view through a third embodiment of a connector block according to our invention corresponding and similar to FIGS. 3 and 4.
Figure 7:
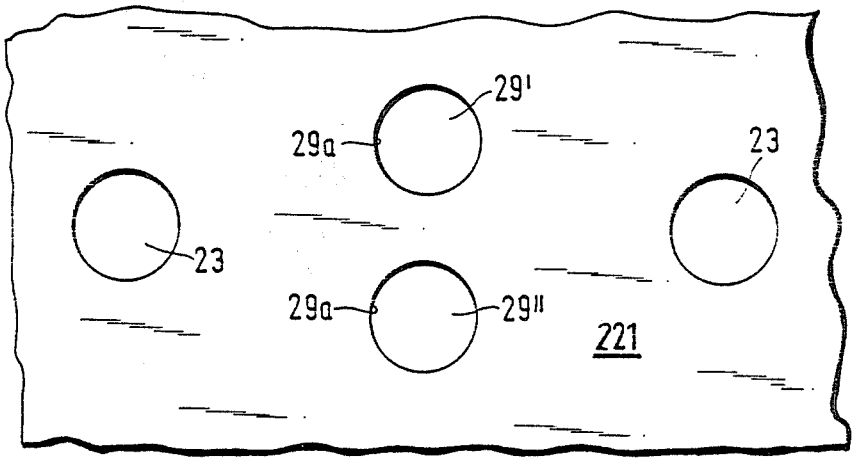
FIG. 7 is a cutaway top plan view of a part of a plate shape connector block support particularly suitable for the connector block shown in FIG. 6.

The embodiments shown in FIGS. 4 and 6 also have the mentioned and additional advantages. Insofar as these embodiments are similar to or identical to that according to FIG. 3 their description is not repeated here. Parts of these embodiments which are similar to or the same as the embodiment of FIG. 3 are numbered correspondingly.

In the embodiments of FIGS. 4 and 6 the additional contacting member 24 is not formed by bending but by punching out a flat but unshaped piece of sheet metal or plate. In the embodiment according to FIG. 4 the single piece contacting member 24 can be thought to comprise an anchoring section 47 and a plug 25 formed from the individual sections 39 to 41. The leg section 41 connected to the bend section 40 opposite the connecting section 39 is in contrast to the connecting section 39 somewhat flexible so as to be tolerance compensating. The substantially U-shape plug 25 engages in a connector block support socket 29 similar to the first embodiment according to FIGS. 1 and 3. The edges 46 of the connecting section 39 and the flexible leg section 41 are sharpened for removal of a lacquer or oxide coating on the bounding surfaces 29*a* of the corresponding socket 29.

The plug 125 shown in FIG. 4 is also mounted from the outside and is pushed into a single hole 30 circumferentially fitting the anchoring section 47 until the pushed in bounding shoulder 43 is put in a corresponding fitting groove 44 of the insulating body 11.

Figure 5:
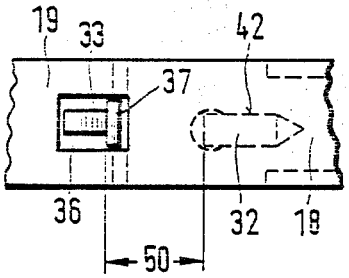
FIG. 5 is a schematic detail view of a part of the connector block seen in the direction indicated by the arrow V in FIG. 4.

The contacting member 124 is held in such a way that at least one of each connecting legs 32 and 33 cooperate or act together with the legs of the contacting spring 19 and the clip 18. This occurs because the connecting leg 32 is forced in the smaller clamping slot 42 of the clip 18 and is held clamped in it. The second connecting leg 33 can of course analogously be held in another section of a contacting spring or clip, but here braces itself on the left edge of the tongue 37 as seen in FIG. 5 locked therein by its shape and size or force-locked. The connecting leg 32 is clamped on the edges of the cut out 42 a distance 50 from the connecting leg 33.

The embodiment according to FIG. 6 differs from the embodiment according to FIG. 4 in that two plugs 225 are attached to the anchoring section 47 of the additional contacting member 224. Both these plugs 225, of which each has substantially the same shape as the plug 225 according to FIG. 4, are positioned so as to be mirror images of each other; their connecting sections 39 positioned exteriorly and their flexible leg section 41 interiorly. This "twin plug" is advantageously designed for plugging the connector block 10 into a connector block support 221 having two equal sockets 29′ and 29″. By the twin plug-in arrangement the protective conductor electrical contact and the required demounting force can be improved even more.

FIG. 6 shows, moreover, that it is possible to increase both the force required to pull out the additional contacting member 224 from the insulating body 11 and also the force required to pull the plugs 225 from the sockets 29′ and 29″. For this purpose, there are hook like locking catches 48 on the outside edges 45 of the connecting legs 32 and 33 near the anchoring section 47 and there are similar locking catches 49 on the connecting sections 39 of the plugs 225 on the outside edges 46.

Apparently, the edges of the locking catches 48 and 49 are usually formed so that they do not prevent the insertion or plugging in of the additional contacting member 224 in the insulating body 11 and/or in the sockets, although they indeed provide a definite increase in the force required to pull them out.

The locking catches 48 and 49 used in the embodiment of FIG. 6 or similar structures can understandably be also used in the embodiment according to FIG.4.

We claim:

1. An electrical connector block assembly, comprising:

a connector block support formed with a plurality of openings at least one of which is a hole adapted to afford an electrical contact;

an insulating body formed with:

a plurality of conductor terminals for respective conductors, means for mounting said body on said connector block support and including insulating plug members receivable in some of said openings, and a protective terminal for engaging a further conductor and comprising a bent metal member in said body having an end bent away from a base of said body adapted to lie against said block support, and a recess formed in said member; and an additional contacting member for said protective terminal, formed in one piece from sheet metal, mountable on said body from the exterior of said base, and comprising:

a bend section projecting outwardly away from said base of said body and engaging in said hole of said block support to form an electrical connection therewith, said bend section having a pair of shanks separated by a bight, a first connecting leg extending inwardly of said body from said base, said end of said bent metal member being braced laterally against said first connecting leg, and a second connecting leg extending inwardly of said body from said base, spaced from said first leg, reaching through said recess and in electrical contact with said bent metal member at a location thereon spaced from said end.

2. The electrical connector block defined in claim 21 wherein said bend section is provided with sharp edges to penetrate an insulating layer covering said connector block support.

3. The electrical connector block defined in claim 1 wherein said sharp edges are on a plurality of outwardly extending flexible prongs.

4. The electrical connector block defined in claim 1 wherein said additional contacting member is formed in a single piece by bending a sheet-metal strip.

5. The electrical connector block defined in claim 1 wherein said additional contacting member is punched out in a single piece from a flat sheet-metal strip.

6. The electrical connector block defined in claim 1 wherein at least one of said connecting legs of said additional contacting member is engaged in a clamping slot of a spring in a connector body.

7. The electrical connector block defined in claim 6 wherein said additional contacting member is provided with at least one shoulder engageable in a base side fitting groove of said insulating body for centering and mounting.

8. The electrical connector block defined in claim 7 wherein said additional contacting member is provided with a plurality of hook shape locking ctches on the edges of an anchoring section thereof for anchoring to said insulating body and in said body and in said connector block support.

9. The electrical connector block defined in claim 1 wherein said additional contacting member is provided with two bend sections each adapted to engage in a hole of said block support.

10. The electrical connector block defined in claim 1 wherein one of said connecting legs has a bent insert portion for insertion in one of two holes formed in said insulating body and a the other of said connecting legs has a folded-over plug-in segment for mounting in another one of said holes of said insulating body.

11. An eletrical connector block assembly comprising:

an insulating body;

a connector block support on which said body is mountable;

a plurality of conductor terminals including:

at least one protective conductor terminal;

an additional contacting member for said protective conductor terminal which passes through a base of said insulating body facing said connector block support and can make electrical contact with and in said connector block support;

an exterior plug in said additional contacting member for direct contact in and engagement with a socket of said connector block support;

a plurality of sharp edges on each of said plugs to penetrate an insulating layer covering said connector block support; and a plurality of outwardly extending flexible prongs on which said sharp edges are formed;

two holes in said base of said insulating body to be connected electrically with said protective conductor terminal, two connecting legs for each of said plugs being connectable with said protective conductor terminal, one of said connecting legs having a bent insert portion for lateral engagement with one of said holes in said insulating body and a folded over plug-in segment for mounting in another one of said holes; and a recess formed in said protective conductor terminal in which one of said connecting legs is clamped, a protruding member of said protective conductor terminal on which the other of said connecting legs is braced, said additional contacting member being formed from a single piece by bending a sheet-metal strip.

* * * * *